US005159147A

United States Patent [19]

Menges et al.

[11] Patent Number: 5,159,147

[45] Date of Patent: Oct. 27, 1992

[54] ALTERNATABLE DUAL CARTRIDGE SUPPLY SYSTEM FOR AN EXTERNALLY DRIVEN AUTOMATIC WEAPON

[75] Inventors: Horst Menges, Ratingen; Lothar Post, Düsseldorf; Bernhard Schneider, Niederkrüchten, all of Fed. Rep. of Germany

[73] Assignee: Rheinmetall GmbH, Düsseldorf, Fed. Rep. of Germany

[21] Appl. No.: 94,261

[22] Filed: Aug. 17, 1987

[30] Foreign Application Priority Data

Aug. 16, 1986 [DE] Fed. Rep. of Germany ..... 3627360

[51] Int. Cl.[5] ..... F41A 9/00

[52] U.S. Cl. ..... 89/33.04; 89/11

[58] Field of Search ..... 89/33.04, 33.25, 33.01

[56] References Cited

U.S. PATENT DOCUMENTS

| | | | |
|---|---|---|---|
| 3,429,221 | 2/1969 | Kirkpatrick | 89/33.16 |
| 3,662,646 | 5/1972 | O'Brien et al. | 89/33.04 |
| 3,995,527 | 12/1976 | Schiele et al. | 89/33.04 |
| 4,397,216 | 8/1983 | Tassie | 89/33.04 |
| 4,416,185 | 11/1983 | Schenk | 89/33.04 |
| 4,494,440 | 1/1985 | Koine | 89/33.04 |
| 4,612,843 | 9/1986 | Marcon et al. | 89/33.04 |

FOREIGN PATENT DOCUMENTS 2303953 7/1977 Fed. Rep. of Germany .

*Primary Examiner*—David H. Brown

*Attorney, Agent, or Firm*—Spencer, Frank & Schneider

[57] ABSTRACT

For installation in confined areas, an externally driven automatic weapon includes an alternatable dual cartridge supply system having two supply chutes are disposed parallel to an axis of symmetry traversing a cartridge supply rotor and a control roller for the breech block drive. The internal guide surfaces of both chutes are formed by a central guide disposed on the axis of symmetry, with the maximum width of this central guide corresponding to the chord length of a segment of the rotor which is provided with three, symmetrically disposed recesses, so that the introduction of cartridges into the rotor from the linear cartridge chute can take place, for example, directly from the top. The supply of cartridges to the rotor is always effected during any given period of time from only one chute. If cartridges are supplied from the other chute, the direction of rotation of rotor changes so that the cartridges are transported directly from the waiting position of a respective supply star wheel associated with each chute and fixed to the weapon housing, into a recess of the rotor and are transferred by stepwise movement of the rotor to a breech block for further transport into a cartridge chamber. During the continuous supply of cartridges by a further star wheel fixed to the cradle housing to the star wheel fixed to the weapon housing, guide means guide the cartridges in the axial direction within the chutes. To eject cartridge casings, a guide lever associated with the chute not then being used to supply cartridges is pivoted into the associated chute in the lateral rotor region to direct the empty cartridge casings into a casing chute.

10 Claims, 4 Drawing Sheets

133
132
154
156
139
134
155
160
131
159
73
63
141
158
27
26
29
36
3
30
157
31
IX
18
153
145
130
9
142
70
28
32
52
10
16
120
12
148
47
56
65
59
VIII
2
11
4
143
140
1
15
8
25

ALTERNATABLE DUAL CARTRIDGE SUPPLY SYSTEM FOR AN EXTERNALLY DRIVEN AUTOMATIC WEAPON

CROSS REFERENCE TO RELATED APPLICATIONS

The present application is related to applicants' following concurrently filed United States Patent Applications, the subject matter of which are incorporated herein by reference:

(1) U.S. patent application Ser. No. 07/092,733, entitled RIGIDLY LOCKABLE STRAIGHT-ACTION BREECH BLOCK FOR AN EXTERNALLY DRIVEN AUTOMATIC WEAPON;

(2) U.S. patent application Ser. No. 07/092,734, entitled RAPID-STOP DEVICE FOR AN EXTERNALLY DRIVEN AUTOMATIC WEAPON and, (3) U.S. patent application Ser. No. 07/094,260, entitled AUTOMATIC WEAPON.

BACKGROUND OF THE INVENTION

The present invention relates to an alternatable dual cartridge supply system for an externally driven automatic weapon. More particularly, the present invention relates to an alternatable dual cartridge supply system for an externally driven automatic weapon which selectively transfers the cartridges from one or the other of two cartridge chutes which are disposed on opposite sides of a rotor equipped with three recesses for conveying the cartridges, a recess of the rotor for further transport to a breech block disposed so as to be longitudinally displaceable on the bore axis of the barrel of the weapon for transfer of the cartridge into the cartridge chamber, with the breech block being driven by a control roller connected with the rotor and jointly therewith fixed to or mounted on the weapon housing, and with supply star wheels of the dual cartridge supply system, the rotor and the control roller being connected together in a form locking and driving manner so that the rotor is driven in steps while the star wheels or wheels supplying the cartridges and the control roller are driven continuously.

In an automatic weapon of the above type disclosed in European Patent Application EP-OS 129,457 corresponding to U.S. Pat. No. 4,612,843, belted ammunition is supplied selectively by means of a left or right cartridge supply device to a central rotor which forwards the cartridges by stepwise rotation to a breech block ready to be pushed into the cartridge chamber. The housing of each cartridge feeding system is connected in an articulated manner on the side of a breech block control roller with the parts of the weapon which move back and forth during firing. To supply the cartridges, each cartridge supply housing is provided with a supply star or sprocket wheel which is driven at a constant rpm. However, cartridges can be supplied only through that star wheel whose cartridge supply housing has just taken on the position in which it is pivoted opposite the rotor. In the pivoted-out position, the drive of the respective star wheel is automatically interrupted. In the normal operating position of the automatic weapon, the cartridges are externally supplied from the bottom to each star wheel by the belts guided in the supply housing and once they are taken out of the belt, the cartridges are transported around a star wheel for lateral transfer into a recess of the rotor.

In this automatic weapon it is considered to be a drawback that, due to the belt entering the feed housing externally from opposite a star wheel and due to the cartridges rotating around the respective star wheel as well as due to the exclusively lateral cartridge transfer into the rotor recess and, furthermore, due to the fact that a feed housing must always be pivoted to transfer the cartridges into the rotor a large amount of space compared to the width of the weapon must be made available. Consequently, for operation of such an automatic weapon, which may, for example, be mounted within the narrow confines of the ring mount of a turret space restraints must be expected. Moreover, a space consuming actuating mechanism is additionally required to pivot the feed housing in and out. When the feed housing is in the pivoted-out position, further means are required to hold the unbelted cartridges which have not yet been moved into the rotor recesses. A further drawback of this alternatable supply system is that, before entering the alternatable supply system, the cartridges are not axially guided so that such a possibly freely movable belt arrangement is not suitable for use with cylindrical cartridges which are sensitive to shocks.

SUMMARY OF THE INVENTION

It is therefore an object of the invention to provide a space saving alternatable dual cartridge supply system for use in automatic weapons installed in confined quarters, with such supply system additionally ensuring the safe supply of unbelted cylindrical cartridges which are sensitive to shocks.

The above object is generally achieved according to the present invention by an externally driven automatic weapon including a gun barrel having a cartridge chamber, a weapon housing, a straight action breech block mounted in the weapon housing for longitudinal movement in a direction parallel to the bore axis of the barrel between a rest position wherein it receives a cartridge to be fired and a locked position so as to transport the received cartridges along the bore axis and into the cartridge chamber of the barrel, a control roller, for controlling the movement of the breech block, symmetrically disposed within the weapon housing beneath the breech block for rotation about a longitudinal axis parallel to the bore axis, and a dual cartridge supply system, including first and second linear cartridge guide chutes symmetrically disposed o opposite sides of the breech block for selectively supplying cartridges from one of said chutes to said breech block when it is in the rest position, with the dual cartridge supply system further including a rotor, having three symmetrically disposed cartridge receiving recesses in its periphery, symmetrically mounted in the weapon housing above said breech block for rotation about an axis parallel to the bore axis for conveying cartridges supplied via the chutes to the breech block, first and second supply star wheels, rotatably mounted in the weapon housing adjacent the rotor for rotation about respective longitudinal axes parallel to the bore axis, for transporting supplied cartridges along the first and second chutes, respectively, to the rotor and drive means connected to the rotor, the star wheels and the control roller for driving the rotor in steps while driving the star wheels and the control roller continuously; the improvement wherein said dual cartridge supply system further comprises:

a further housing mounted on a cradle or gun mount and connected to the weapon housing;

a respective cartridge supply means for supplying cartridges to each chute, mounted in the further housing, with each supply means including a respective endless conveyor chain for conveying cartridges to the respective chute, a respective further star wheel disposed adjacent the associated one of the first and second star wheels for rotation about a parallel axis and around which the respective conveyor chain extends so that the further star wheel forms a direction changing device for the conveyor chain and supplies cartridges into the transfer range of the associated first or second star wheel;

a central guide, having an axis of symmetry which extends through the axes of the rotor and the control roller, extending from the rotor between the first and second star wheels and the further star wheels associated with the first and second chutes with the two outer opposed surfaces of the guide defining the inner surfaces of the respective chutes and with these two outer opposed surfaces, at least in the region extending from the rotor and disposed between the first and second star wheels being parallel to said the of symmetry, and the spacing between the two outer opposed surfaces of the central guide is such that direct introduction of cartridges from the respective first and second linear cartridge chutes into the respective recesses of the rotor is possible; and a respective axial guide means associated with each of the first and second cartridge chutes for axially guiding the cartridges in the respective chutes, with each axial guide means extending from the region of breech block to the region of the further housing above the associated further star wheel.

The configuration of the cartridge chute for the double belt supply system according to the invention makes it possible in an advantageous manner that unbelted, shock-sensitive, cylindrical cartridges can be supplied in a positive manner within the narrowest confines into a breech block which is to be displaced into a cartridge chamber. A closely adjacent two chute configuration then makes it possible to effect the supply of cartridges alternatingly from two chutes directly from a supply system, for example from the top, into the respective recess of a rotor which transfers the cartridges in steps to the breech block.

In a particularly space saving manner, the outer surfaces of the central guide then constitute a respective internal guide path for each chute, so that the supply of cartridges becomes possible in a region between the supply star wheels of both chutes. In the region of the star wheels, space consuming cartridge guide systems, as they are known to be necessary for the lateral supply of cartridges into the rotor and, for example, with the supply of cartridges from the bottom, are now no longer necessary. The narrow configuration of the chute design according to the invention therefore also permits unimpeded mounting in confined spaces, for example within the close quarters of the turret ring mount.

The arrangement according to the invention of an endless ammunition supply system extending into the range of influence of the supply star wheel fixed to the weapon and the arrangement of axial ammunition guide means permit a secure transport, free of danger, of shock sensitive cartridges within the entire supply region extending from the housing fixed to the cradle to the breech.

According to an advantageous feature of the invention, the direct supply of cartridges through two cartridge chutes, for example from the top, into the respective rotor arrangement becomes possible in that the maximum interior distance a between the two chutes defined by the exterior surfaces of the central guide in the housing portion connected to the weapon corresponds to the length of the chord of a rotor segment between two rotor recesses. The width of the alternatable dual cartridge supply system is further restricted in that the portion of the central guide in the housing portion fixed to the cradle has a reduced width compared to the portion of the control guide housing region fixed to the weapon.

According to a further feature, the cartridges in each chute are slidingly deflected by a guide fixed to the cradle from the endless ammunition conveyor into the range of influence of the associated supply star wheel fixed to the weapon.

In a further advantageous manner, the longitudinal limitation of each chute in the circumferential region of the rotor near the path of the breech block is composed of a guide lever which is pivotal into the region of the chute and is provided with axial cartridge guide means, thus ensuring, on the one hand, axial guidance of the cartridges during rotation of the rotor and, on the other hand, an ejection chute for a deflected empty cartridge if the guide lever is pivoted into the chute region. Due to the fact that this guide lever already takes over the guidance of the cartridges in the region of influence of the supply star wheel mounted on the weapon, steady guidance of the cartridges from the outside is assured in the radial and axial direction until they are transferred to the breech block.

According to still a further feature of the invention, in the region of the continuously rotating ammunition conveyor, the cartridges ar guided in the axial direction by a movable guide. This guide is composed of U-shaped frame elements whose arms, on their interior surfaces, include cams or detents which engage into the extraction groove of a cartridge. One end of this guide is fixed to the cradle housing and the other end is fixed to the weapon housing so that, even if the housing fixed to the weapon moves back and forth due to the development of a shot, secure axial cartridge guidance is ensured. The guide stresses during the back and forth movement of the weapon are here held to a minimum with respect to the end fixed to the cradle housing by a symmetrical movement stroke of the end of the movable guide fixed to the weapon housing.

According to a further feature, the drive shafts of the star wheels which are fixed to the weapon and the drive shaft of the rotor are configured as spline shafts, so that it is possible to dispose maintenance free gear parts in the housing fixed to the cradle. The spline shafts are able to slide in an axially longitudinal direction within the gear assembly during the back and forth movement of the weapon, thus preventing, in a particularly advantageous manner, the parts of the gear assembly from being subjected to the firing forces and thus realizing a long expected service life. Moreover, the spline shafts permit maintenance friendly and rapid disengagement of the entire housing fixed to the weapon from the housing fixed to the cradle.

Moreover, the particular configuration and arrangement of the alternatable dual cartridge supply system particularly the cartridge supply, the case ejector, the positive movement of the supply star wheels and the rotor, eliminate interferences or problems such as cartridge jams, cartridges that run underneath the system, caught cartridge cases, etc.

The invention will be described in greater detail below with reference to an embodiment that is illustrated in the drawings.

DETAILED DESCRIPTION OF THE PREFERRED EMBODIMENTS

Figure 1:
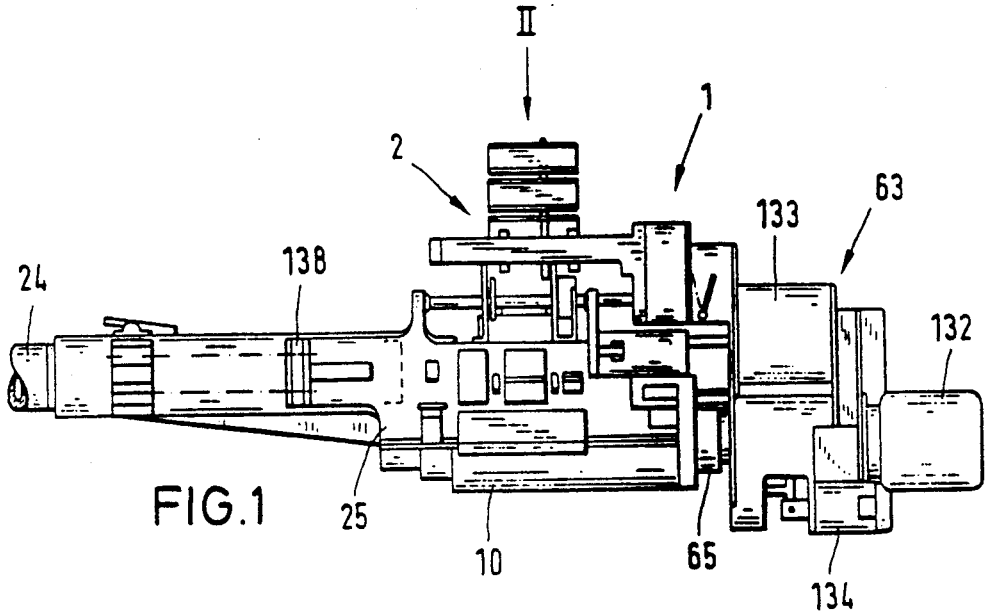
FIG. 1 is a side view of an externally driven automatic cannon having an alternatable dual cartridge supply system according to the invention.
Figure 2:
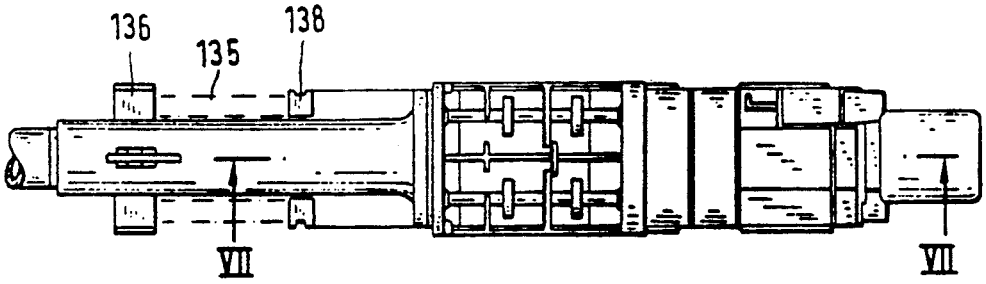
FIG. 2 is a top view in the direction marked II in FIG. 1.
Figure 3:
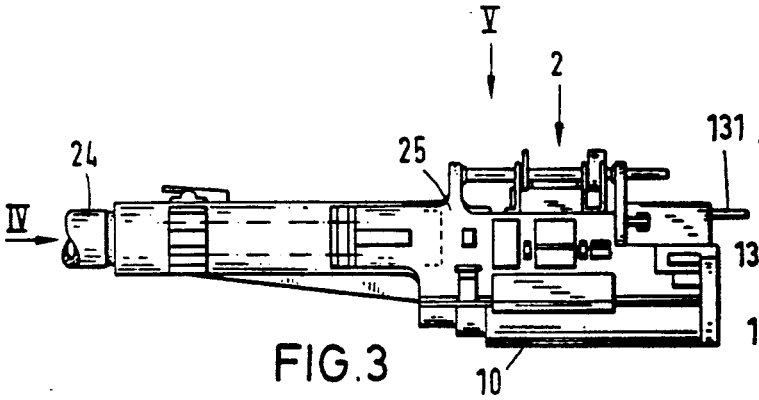
FIG. 3 is a side view of the weapon of FIG. 1 showing only the devices or parts fixed to or mounted on the weapon itself.
Figure 5:
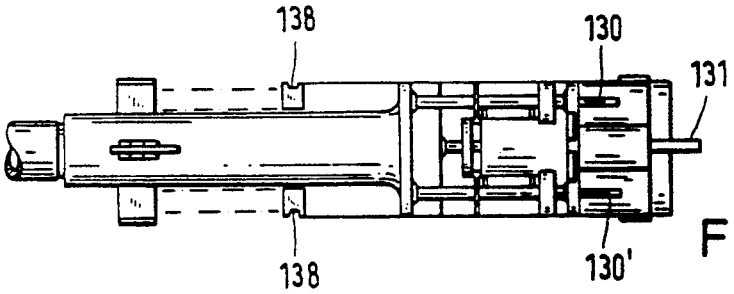
FIG. 5 is a top view in the direction marked V in FIG. 3.
Figure 6:
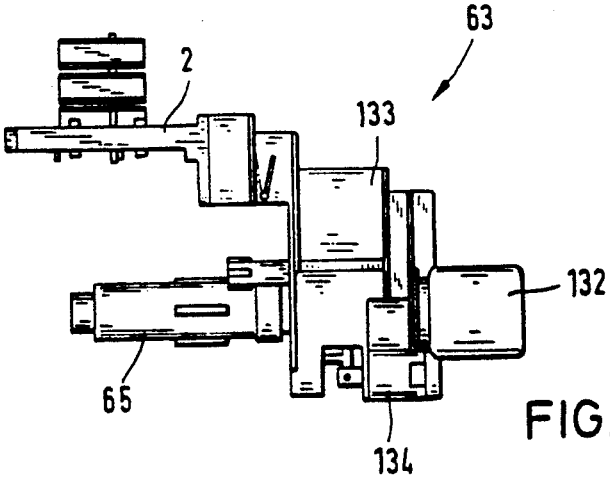
FIG. 6 is a side view of the devices fixed to or mounted on the cradle housing.

FIGS. 1 and 2 show the overall structure of an externally driven automatic weapon 1 in which the external drive 132 for the weapon, an associated gear assembly 133, a trigger mechanism 134, a brake unit 65 for a control roller 10, and a first partial region of an alternatable dual cartridge supply system 2 are disposed in a housing 63 which is shown individually in FIG. 6 and which is fixed to or mounted on the cradle or the gun mount. In a housing 25, shown in FIGS. 3 to 5, which is connected with the gun barrel 24 and recoils together therewith when a shot is fired, there are disposed the control roller 10 for the breech block drive, a breech block 9 (FIG. 7), a breech lock 143 (FIG. 7), a recoil braking and counterrecoil device 135 as well as a second partial region of the alternatable dual cartridge supply system 2.

Figure 4:
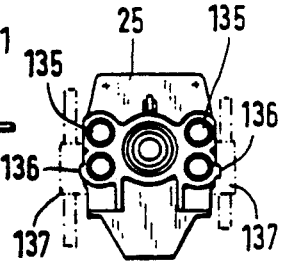
FIG. 4 is a top view in the direction marked IV in FIG. 3.
Figure 8:
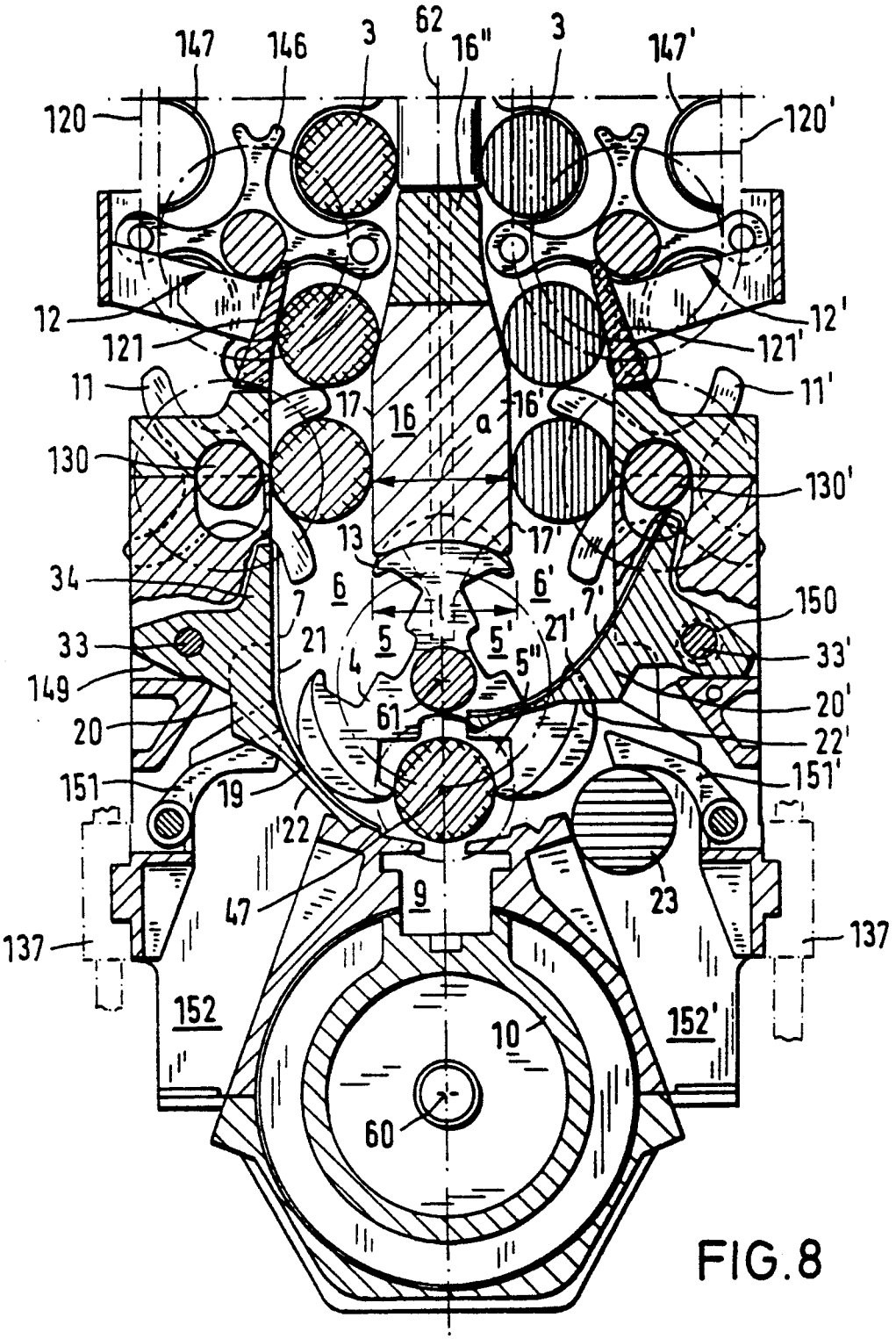
FIG. 8 is a cross-sectional view of the alternatable dual cartridge supply system seen along the line marked VIII—VIII in FIG. 7.

Housing 25 which is fixed to the weapon is provided on its exterior with slide guides 136 for fastening the housing 25 within a weapon carrier 137 which is shown schematically in FIGS. 4 and 8 and which may be articulated in the form of a gun mount (not shown) or a cradle in the turret system (likewise not shown) of a tank. Weapon housing 25 is equipped with two fast action locks, one lock 138 connecting weapon housing 25 with weapon carrier 137, while the other lock is disposed at the point of intersection between the ammunition guide and weapon housing 25.

Figures 7, 9:
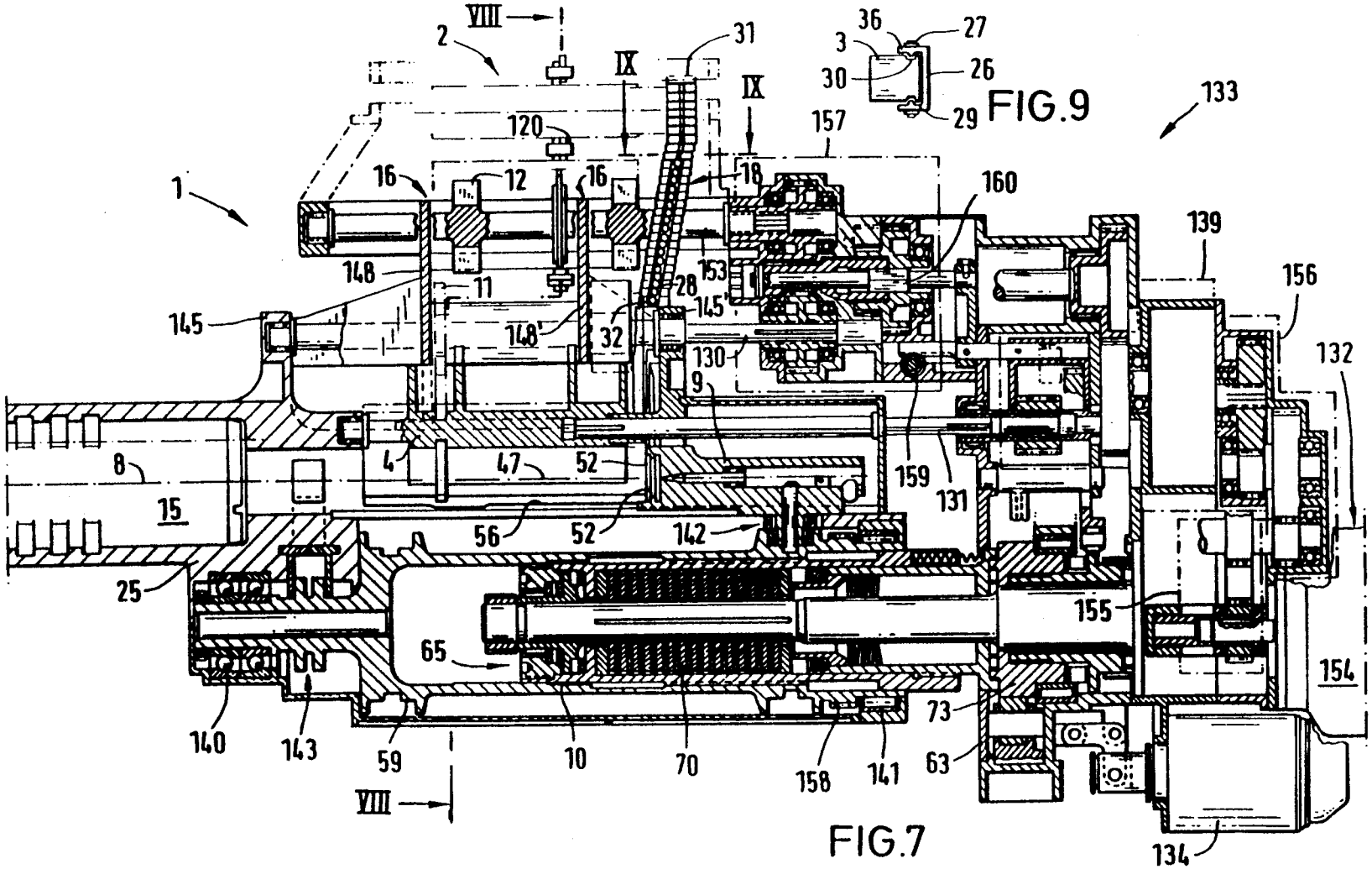
FIG. 7 is a longitudinal cross-sectional view of the automatic weapon along the line marked VII—VII in FIG. 2.
FIG. 9 is a cross-sectional view of the flexible cartridge guide seen along the line marked IX—IX in FIG. 7.

The further detailed configuration of automatic weapon 1, particularly that of alternatable dual cartridge supply system 2, will be described below with reference to FIGS. 7 to 9.

Control roller 10 is mounted in weapon housing 25 for rotation about a longitudinal axis 60 parallel to the extended bore axis 8 of the gun barrel and includes, on its exterior, a cylindrical track 59 for the longitudinal movement of a straight-action breech block 9 which moves a preferably cylindrical cartridge 3 into the cartridge chamber 15. In order to perform this longitudinal movement, breech block 9 is provided, in a known manner, with control means 142 which engage in cylindrical track 59 so as to cause the block 9 to move upon rotation of the control roller 10 either toward or away from the cartridge chamber, depending on the direction of rotation of the roller 10. One-piece, rigid extraction claws 52 are provided at the front of the breech block 9. These claws 52 are used to transport a cylindrical cartridge 3 without shock into the chamber 15 along a breech block path axis 47, which changes to the bore axis 8 of the gun barrel, and after firing, to extract the cartridge case 23 from chamber 15. In the forward position, breech block 9 is positively locked, during firing of a shot, by a locking mechanism 143 which is not part of the invention. Locking mechanism 143 is the subject of one of the above-identified concurrently filed United States Patent Applications of applicants, so that a more detailed description thereof is not necessary here.

On the side of breech block path axis 47 facing away from control roller 10, on an axis of symmetry 62 passing through breech block path axis 47 and the longitudinal axis 60 of control roller 10, a rotor 4 provided with three symmetrically disposed peripheral recesses 5, 5', 5'' is mounted so as to be rotationally movable within weapon housing 25 about an axis 61 extending parallel to the axes 47 and 60. This rotor 4 is driven by a known stepping gear 139 which is disposed within housing 63 mounted on the cradle and is integrated with drive 133. Stepping gear 139 is a commercially available cam gear which determines the pause and transporting periods of rotor 4 for alternatable dual cartridge supply system 2. A subsequently connected change gear 157 serves to selectively change the direction of rotation of rotor 4. After each stepwise rotation, one recess 5'' of rotor 4, e.g. recess 5'' as shown, is disposed on breech path axis 47, while the other two recesses, e.g. 5 and 5' as shown, which recesses are all identical and are uniformly distributed over the circumference of rotor 4, are oriented toward a respective cartridge chute 6 or 6', respectively, of alternatable dual cartridge supply system 2.

Both cartridge chutes 6 and 6' are arranged parallel to one another and are formed on the interior by the exterior surfaces 17 and 17' of a central guide 16 disposed on the axis of symmetry 62. The exterior surfaces 17 and 17' of central guide 16 form an internal guide path for each respective chute 6, 6', and are spaced from one another such that direct introduction of cartridges 3 from the linear cartridge chutes 6 and 6', for example from the top, into the respective facing recess 5, 5' or 5'' of rotor 4 is possible. The maximum spacing a between chutes 6 and 6', each delimited by the exterior surfaces 17 and 17' of central guide 16, corresponds to the chord length 1 of a rotor segment 13 disposed between two recesses 5, 5', 5''.

Each chute 6, 6' has two associated supply star wheels 11, 12 and 11', 12', respectively, with the star wheels 11, 11' facing or adjacent rotor 4 rotatably mounted in bearings in the weapon housing 25, e.g., the bearings 145, 145' for the shaft 130, while the respective star wheels 12, 12' which are remote from the rotor 4 are rotatably mounted in suitable bearings in housing 63 which is connected to the cradle or the gun mount. For transporting, preferably unbelted cylindrical cartridges 3 into cartridge chutes 6, 6', each chute is provided with an endless ammunition conveyor 120 or 120' which is mounted in housing 63 fixed to the cradle. A deflection or reversal point for endless ammunition conveyor 120, 120', which is provided in the form of a sprocket chain, is provided by configuring star wheels 12, 12' or sprocket wheels having respective sprockets 146, 146' for engaging the endless chains 120, 120' in a conventional manner. The chains 120, 120' are provided with half shells 147, 147' for conveying the cartridges so that cartridges 3 can be transported into the range of influence of star wheels 11, 11' fixed to the weapon housing. The cartridges 3 are deflected or reversed from the chains 120, 120' by respective guides 121, 121' fixed to the cradle housing 63 so as to engage the respective wheels 11, 11' for further transport into the regions of the chutes 6, 6' disposed on the weapon itself.

The central guide 16 for both cartridge chutes 6, 6' is formed of two parts, with one part 16' being disposed in the region of star wheels 11, 11' fixed to the weapon and is likewise fixed to the weapon housing 25, while the other portions 16" of central guide 16 is disposed in the region of star wheels 12, 12' and is fixed to the cradle housing 63. Central guide 16 is preferably provided in the form of front and rear webs 148 adjacent the front and rear of the elongated wheels 11, 11', 12, 12', as shown in FIG. 7. In region 16" which is fixed to the cradle, guide 16 has a smaller width compared to the spacing a of region 16' fixed to the weapon, so that the spacing of star wheels 12, 12', which are fixed to the cradle is likewise shortened in a space saving manner.

Between star wheel 11, 11' fixed to the weapon and rotor 4, each chute 6, 6' is equipped, with a respective guide lever 20, 20' which can be pivoted into the region of the respective chute and which form the outer longitudinal delimitation of the respective chute 6, 6' in the lateral circumferential region of rotor 4 near breech path guide 56. On its side 21, 21' facing and defining each respective chute 6, 6', each guide lever 20, 20' includes an external longitudinal cartridge guide 7, 7' in the form of an axial guide means 19 which engages in the known extraction groove of cartridge 3 so as to ensure axial guidance of the cartridge even while it is being moved by rotor 4 into the position of the respective recess facing breech block 9, recess 5" as shown. The side or surface 22, 22' of each guide lever 20, 20' facing away from the respective chutes 6, 6' forms a guide for the cartridge casing 23 to be ejected when the respective guide lever 20 or 20' is in a position in which it is pivoted into the chute, as shown, for example, for the guide lever 20' in FIG. 8. The inward pivoting movement of each guide lever 20, 20' is effected by a respective rotation spring 150 mounted on the pivot axis 33, 33' of the respective guide lever 20, 20', with the pivoting stroke of each guide lever being limited by a stop 149 which engages a portion of the housing 25. Each lever 20 is pivoted back automatically due to cartridges 3 moving in the respective chutes 6, 6'. In the pivoted back position, the front end of the guide section of lever 20, in the vicinity of joint 33, lies against housing 25 which is fixed to the weapon. The cartridge guide 7, 7' of each guide lever 20, 20' includes a linear or straight guide section 34 disposed above the respective lever joint 33, 33'. This linear guide section 34 changes tangentially into a lower circular arc shaped guide section 35 which substantially extends to and opens into the respective recess 5, 5' or 5" of rotor 4 disposed opposite breech block 9 and, in the incoming position of a cartridge 3, provides axial guidance extending into the range of 10 influence of star wheel 11, 11' fixed to the weapon.

Disposed between housing 63, which is fixed to the cradle, and the alternatable housing 25, which is fixed to the weapon and thus moves back and forth during the development of a shot, there is a movable guide means 18 for cartridges 3 which ensures reliable axial cartridge guidance even during the back and forth movement of the weapon housing 25. The movable guide means 18 is composed of U-shaped frame elements 26 whose two arms 36 are provided, on their exterior, with joints 27 to accommodate pivotally movable tongues 28 and, on their interior, with cams or detents 30 which engage in the extraction groove 29 of cartridge 3. One end 31 of movable guide 18 is fastened to housing 63 in the direction of the supply of cartridges 3 and the other end 32 is fixed to the portion of weapon-fixed housing 25 containing part of the alternatable dual cartridge supply system 2. The movement stroke of this guide 18, which moves back and forth together with the housing 25 fixed to the weapon, is symmetrical with the end 31 fastened to housing 63 fixed to the cradle.

Shafts 130, 131, 153 of star wheels 11, 12, 11', 12' and of rotor 4 are connected together in a form-locking and driving manner so that rotor 4 is driven in steps but the star wheels are driven continuously.

For this mode of operation, the drive 133 disposed in housing 63 fixed to the cradle is composed of a plurality of units which are interconnected in a form locking manner. First the number of revolutions of motor 154 is adapted by means of an intermediate gear 155 to the number of revolutions of the weapon system. Intermediate gear 155, in a known manner, includes coupling and protective devices. In the subsequent distribution gear 156, the number of revolutions is adapted to a stepping gear 139, to a change gear 157 and to a gear (not shown) to drive control roller 10. Change gear 157 distributes the continuous rotational motion to shafts 130, 153 of star wheels 11, 12, 11', 12' and permits, by shifting the couplings (not shown), rapid change of the type of ammunition and arresting of the star wheels 11, 12 or 11', 12' belonging to chute 6, 6' not in operation, so that cartridges 3 can be selectively supplied from cartridge chute 6 or 6' arranged to the left or right, respectively, of rotor 4 to the recesses in rotor 4.

Drive shafts 130, 130', 131 of star wheel 11, 11' fixed to the weapon housing, and rotor 4 fixed to the weapon housing are configured, in order to be able to be axially displaced during the recoil and counterrecoil movement, as spline shafts which are displaceable along the longitudinal axis in change gear 157 and in stepping gear 139, respectively. Likewise, control roller 10 is arranged to be longitudinally displaceable on brake unit 65 by means of the same type connecting means, i.e. a splined shaft. Brake unit 65 is the subject of another of the above-identified concurrently filed applications of applicants so that a detailed description of brake unit 65 is not required here. In general, the brake unit 65 functions so that, in the case of malfunction or if the weapon drive is stopped, brake shims 70 are axially compressed, in a manner not shown in detail here, by means of an axially displaceable brake disc 73 so that the control roller 10, which is connected with distribution gear 156 in a manner likewise not shown, is braked when the breech is in a secured position.

Sequence of functions:

Initially, both cartridge chutes 6 and 6' are loaded with cartridges 3 up to a waiting position produced by respective star wheel 11 and 11' mounted on the weapon, with the waiting position of the cartridges being produced by form-locking arresting of the stopped star wheels. When the weapon drive starts up, control roller 10 moves breech block 9 into the rearward rest position. In this position, cartridges 3 are transferred by the continuously rotating star wheels 11, 12 or 11', 12' associated with the chute 6 or 6' then being used to the stepped rotor 4 and by the rotor 4 to the breech block 9. After firing, with the breech block 9 in the forward, locked position and subsequent unlocking of the breech block, the cartridge casing is extracted from chamber 15 and, when the next cartridge 3 is supplied, is pushed without impact into casing ejection chute 152 by rotation of rotor 4.

The selection of the chute 6 or 6' from which cartridges 3 are supplied is made with the weapon drive stopped. A gear 159 and a coupling rod assembly 160 are used to switch the continuous drive of star wheels 11, 12 or 11', 12' for the preselected supply chute 6, 6' and the associated direction of rotation of rotor 4. The star wheels of each chute 6, 6', which are in the stopped position, are blocked in housing 63 in a known manner not shown here. This causes star wheel 11, 11' on the side of the weapon to arrest cartridge 3 in the waiting position as shown in FIG. 8. Rotor 4 always requires only one cycle to transport a cartridge so that, even if a change is being made from one cartridge chute 6, 6' to the other, only the cartridge of the selected conveying chute, and not wrong cartridge 3 belonging, for example, to the other chute, can be fired.

It will be understood that the above description of the present invention is susceptible to various modifications, changes and adaptations, and the same are intended to be comprehended within the meaning and range of equivalents of the appended claims.

What is claimed is:

1. In an externally driven automatic weapon including a gun barrel having a cartridge chamber, a weapon housing, a straight action breech block mounted in said weapon housing for longitudinal movement in a direction parallel to the bore axis of said barrel between a rest position, wherein it receives a cartridge to be fired, and a locked position so as to transport the received cartridges along said bore axis and into the cartridge chamber of said barrel, a control roller, for controlling the movement of said breech block, symmetrically disposed within said weapon housing beneath said breech block for rotation about a longitudinal axis parallel to said bore axis, and a dual cartridge supply system, including first and second linear cartridge guide chutes symmetrically disposed on opposite sides of said breech block for selectively supplying cartridges from one of said chutes to said breech block when it is in said rest position, said dual cartridge supply system further including a rotor, having three symmetrically disposed cartridge receiving recesses in its periphery, symmetrically mounted in said weapon housing above said breech block for rotation about an axis parallel to said bore axis for conveying cartridges supplied via said chutes to said breech block, first and second supply star wheels, rotatably mounted in said weapon housing adjacent said rotor for rotation about respective longitudinal axes parallel to said bore axis, for transporting supplied cartridges along said first and second chutes, respectively, to said rotor, and drive means, connected to said rotor, said star wheels and said control roller for driving said rotor in steps while driving said star wheels and said control roller continuously; the improvement wherein said dual cartridge supply system further comprises:

a further housing mounted on a cradle or gun mount and connected to said weapon housing;

a respective cartridge supply means for supplying cartridges to each said chute mounted in said further housing, with each said supply means including a respective endless conveyor chain for conveying cartridges to the respective said chute, a respective further star wheel disposed adjacent the associated one of said first and second star wheels for rotation about a parallel axis and around which the respective said conveyor chain extends so that said further star wheel forms a direction changing device for said conveyor chain and supplies cartridges into the transfer range of the associated said first or second star wheel;

a central guide, having an axis of symmetry which extends through said axes of said rotor and said control roller and extending from said rotor between said first and second star wheels and between said further star wheels associated with said first and second chutes, with the two outer opposed surfaces of said central guide defining the inner surfaces of the respective said chutes, with said two outer opposed surfaces, at least in the region extending from said rotor and disposed between said first and second star wheels, being parallel to said axis of symmetry, and with the spacing between said two outer opposed surfaces of said central guide being such that direct introduction of cartridges from the respective said first and second linear cartridge chutes into the respective said recess of said rotor is possible; and a respective axial guide means, associated with each said first and second cartridge chute, for axially guiding the cartridges in the respective said chute, with each said axial guide means extending from the region of said breech block to the region of said further housing above the associated said further star wheel.

2. An externally driven automatic weapon as defined in claim 1, further comprising a respective guide means mounted in said further housing adjacent each said further star wheel, for deflecting the cartridges from the respective said cartridge conveyor chain into the region of the associated said cartridge chute disposed in said weapon housing.

3. An externally driven automatic weapon as defined in claim 1, wherein the drive shafts of said first and second star wheels and of said rotor are configured as spline shafts while one longitudinally axially displaceable in said further housing.

4. An externally driven automatic weapon as defined in claim 1, wherein the maximum said spacing between said two outer opposed surfaces of said central guide defining the inner surfaces of said chutes corresponds to the length of the chord of a segment of said rotor between two adjacent said recesses.

5. An externally driven automatic weapon as defined in claim 4, wherein said central guide has a first portion which is mounted in said weapon housing and has said maximum spacing and a further portion mounted in said further housing and having a respective spacing between its outer opposed surfaces which is less than said maximum spacing.

6. An externally driven automatic weapon as defined in claim 1, wherein: the outer longitudinal delimitation of each said chute in the lateral circumferential region of said rotor near the path of said breech block is formed by the outer surface of a respective guide lever which is pivotally mounted in said weapon housing about an axis parallel to said bore axis so that it can be pivoted into the region of the associated said chute; the surface of each said guide lever facing away from the associated said chute forms a guide for the cartridge casing to be ejected from the breech block when said lever is in said pivoted position; and said axial guide means includes cartridge guide means disposed on said outer surface of each said guide lever for engaging in the extraction groove of a cartridge so as to ensure guidance of the cartridge into the respective said recess of said rotor facing said breech block.

7. An externally driven automatic weapon as defined in one of claim 6, wherein said cartridge guide means disposed on each said guide lever includes a linear guide section disposed above the pivot point of the respective said guide, with said linear guide section changing tangentially into a lower guide section in the form of a circular arc and opening into a said recess of said rotor while forming a guide which extends into the range of influence of the associated said first or second star wheel disposed in the position in which a cartridge is supplied to said rotor.

8. An externally driven automatic weapon as defined in claim 7, wherein said axial guide means includes further guide means for the cartridges connected between said further housing and said weapon housing, which moves back and forth during the development of a shot, with said further guide means for the cartridges being configured as a movable guide which ensures axial cartridge guidance during the recoil and counter-recoil movement of said weapon housing.

9. An externally driven automatic weapon as defined in claim 8, wherein said further movable guide means are composed of a band of connected U-shaped frame elements whose arms, on both sides, are provided on their exterior surfaces with joints to accommodate pivotally movable tongues and are provided on their interior surfaces with detents which engage in the extraction groove of the cartridge.

10. An externally driven automatic weapon as defined in claim 9, wherein: one end of said further movable guide means is fastened to said further housing and the other end of said further guide means is fastened to said weapon housing, with said other end being fastened to said weapon housing at a position such that the movement stroke of said other end of said further guide means, which moves back and forth together with said weapon housing, is symmetrical with respect to said one end of said further guide means fastened to the said further housing.

* * * * *